US005302959A

United States Patent [19]

Harrington et al.

[11] Patent Number: 5,302,959

[45] Date of Patent: Apr. 12, 1994

[54] SINGLE ELEMENT DRIVER ARCHITECTURE FOR FERRITE BASED PHASE SHIFTER

[75] Inventors: William A. Harrington, Whittier; James V. Strahan, Brea, both of Calif.

[73] Assignee: Hughes Aircraft Company, Los Angeles, Calif.

[21] Appl. No.: 841,126

[22] Filed: Feb. 25, 1992

[51] Int. Cl.[5] ..... H01P 1/19; H01Q 3/36

[52] U.S. Cl. ..... 342/372; 343/853; 333/161; 333/24.1

[58] Field of Search ..... 333/161, 164, 158, 24.1, 333/156; 343/853; 342/371-373, 375

[56] References Cited

U.S. PATENT DOCUMENTS

| | | | |
|---|---|---|---|
| 3,553,733 | 1/1971 | Buck | 333/24.1 X |
| 3,753,162 | 8/1973 | Charlton et al. | 333/156 X |
| 4,839,659 | 6/1989 | Stern et al. | 343/785 X |

FOREIGN PATENT DOCUMENTS

| | | | |
|---|---|---|---|
| 1166200 | 7/1985 | U.S.S.R. | 333/161 |

OTHER PUBLICATIONS

Jones, R., Whicker, L. R.; "Now-Ferrite Microstrip Devices"; *Microwaves* Jan. 1969; pp. 32-40.

Roome, G. & Hair, H; "Thin Ferrite Devices For Microwave Integrated Circuits"; *IEEE Trans on Electron Devices*; vol. ED-15; No. 7; Jul. 1968; pp. 473-482.

*Primary Examiner*—Benny T. Lee

*Attorney, Agent, or Firm*—Wanda K. Denson-Low

[57] ABSTRACT

A phase shifter subarray which is useful with a phased array antenna, includes a plurality of phase shifter elements which have substantially equal finite lengths and which are mounted on a ferri-magnetic substrate. An electrical coil is disposed around selected portions of the substrate and a common feed is connected to each of the phase shifter elements to transmit energy through the phase shifter elements to the radiating elements of the antenna. A driver is connected to the coil, and the driver is activated to induce a magnetic flux in the selected portions of the substrate. This flux influences that part of each phase shifter element which is mounted in the selected portions of the substrate and, consequently, the phase of the wave energy which passes through the influenced part of each phase shifter element is shifted to predictably direct the beam radiated from the antenna. For one embodiment, each phase shifter element is bifurcated into first and second segments with the respective first segments being of different length. For this embodiment the flux influences only the first segments of the phase shifter elements. In another embodiment, the phase shifter elements are not bifurcated and, instead, the coil is tapered on the substrate to influence different lengths of each phase shifter element.

9 Claims, 2 Drawing Sheets

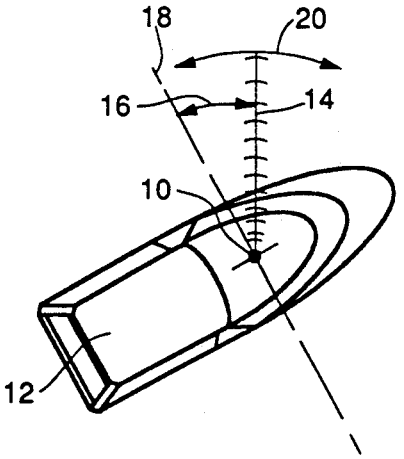
FIG. 1.
FIG. 2
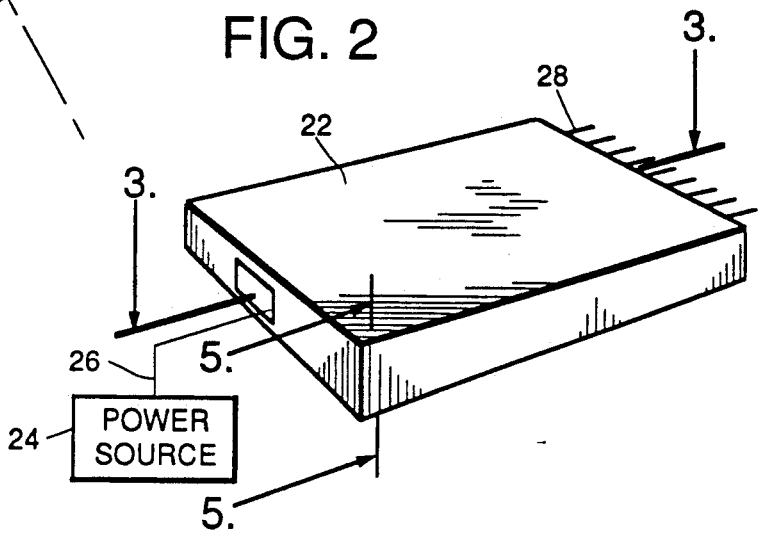
FIG. 3.
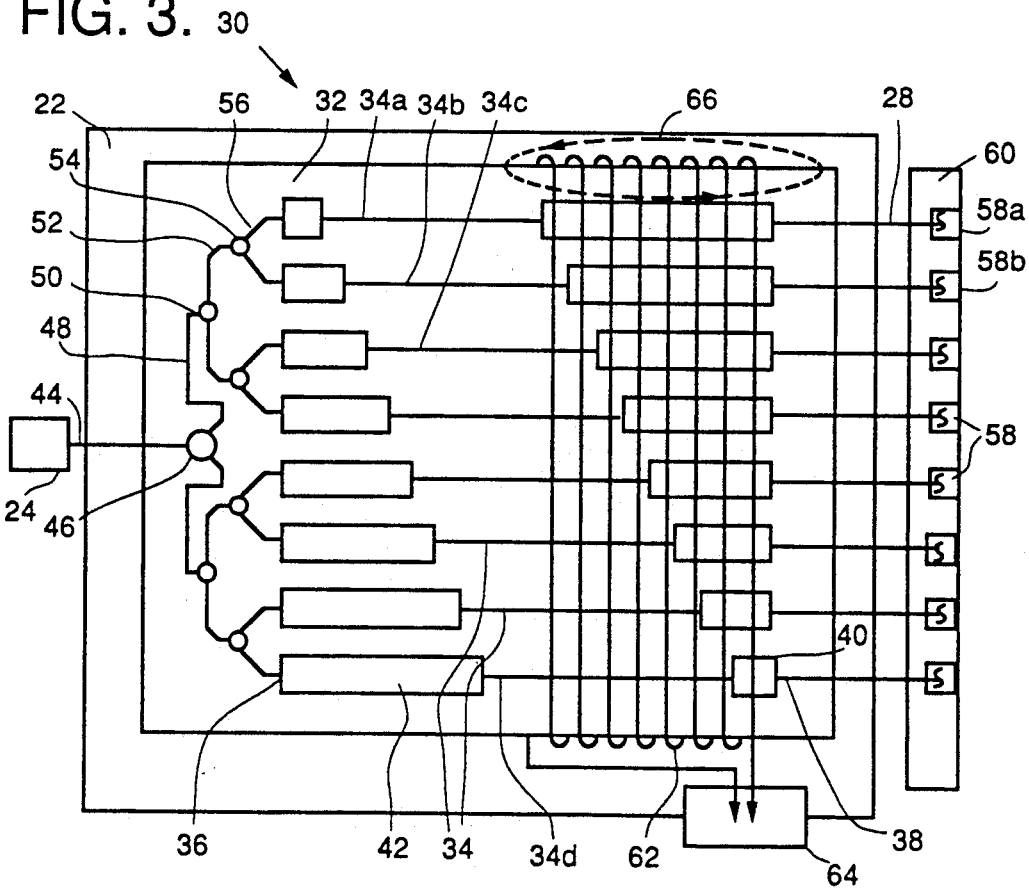

SINGLE ELEMENT DRIVER ARCHITECTURE FOR FERRITE BASED PHASE SHIFTER

FIELD OF THE INVENTION

The present invention pertains generally to phase array antennas. More particularly, the present invention pertains to phase shifter subarrays for directing the radiated beam from an antenna. The present invention is particularly, but not exclusively, useful for the manufacture of phase array antennas which operate at millimeter wave frequencies.

BACKGROUND OF THE INVENTION

As is well known, a phased array radar includes an antenna with an array of identical radiating elements, such as waveguides, horns, slots, or dipoles. Phased array radars typically include a power supply having electronic means for altering the phase of power which is fed to each of the radiating elements. By properly controlling the alteration or shift in the phase of this power at each radiating element, the shape and direction of the radiation pattern can be altered without mechanical movement and with sufficient rapidity to be made on a pulse-to-pulse basis.

In general, phased array radars are extremely sophisticated electronic devices which incorporate precision components that will make the radar capable of achieving high target resolution with minimal delays in response time. Obviously, in order to achieve these capabilities the interaction between various components in a phased array radar must be carefully engineered. In particular, the interaction of various components with the phase shifter elements must be carefully engineered. Indeed, in order to increase precision, it is normally the case that each phase shifter is connected directly to the power feed and has a dedicated driver. This is so in order to minimize any additive effect the phase shifters may introduce into the radar system. At millimeter wave frequencies, however, the physical size of the components become so diminutive that their physical interconnection can pose a significant problem. There are, however, many potential applications for phased array radars using millimeter wave frequencies where relatively slower response times are tolerable, and where high target resolution is not essential.

An example where the performance characteristics of a phased array radar can be somewhat relaxed is a collision avoidance radar for relatively slow moving vehicles. In such a case, the ability of a phased array radar to change the direction of its radiated beam and thereby sweep across a particular area is still important. Some delay in response time, however, may be acceptable. Further, it will typically be the case that lower signal to noise ratios can be tolerated. In sum, the present invention recognizes there are many applications where a phased array radar can be extremely useful even though it may have less precise performance capabilities than are typically necessary for other, more specific, applications.

With the above in mind, the activation of individual phase shifters between the power feed and each of the radiating elements of the antennas became a design consideration of major importance to the present invention. With the knowledge that a circularly polarized wave is easily influenced by a magnetic flux field, the present invention recognized that though there are some inherent losses involved, each phase shifter in a phase shifter subarray need not have a dedicated driver. Specifically, the present invention recognizes that a plurality of phase shifter elements can be ganged together and differentially influenced by a common flux field.

In light of the above it is an object of the present invention to provide a phase shifter subarray for use in directing the beam of a phased array antenna which consolidates similar type components in order to simplify the interaction of different components. Another object of the present invention is to provide a phase shifter subarray for use in directing the beam of a phased array antenna which uses a single current mode driver to accomplish deflection of the radiated beam by driving all of the phase shifter elements in series. Still another object of the present invention is to use a common electrical coil for creating a flux field that differentially influences the phase shifters in the subarray to direct radiation from the antenna. Yet another object of the present invention is to provide a phase shifter subarray for use in directing the beam of a phased array antenna which tolerates relatively low signal to noise ratios during target acquisition. Another object of the present invention is to provide a phase shifter subarray for use in directing the beam of a phased array antenna which is reliable for use as a collision avoidance radar on relatively slow moving vehicles. Still another object of the present invention is to provide a phase shifter subarray for use in directing the beam of a phased array antenna which is relatively easy to manufacture, is simple to use, and is comparatively cost effective.

SUMMARY OF THE INVENTION

A phase shifter subarray for use in directing the beam of a phase array antenna includes a ferri-magnetic substrate which has a plurality of phase shifter elements mounted on the substrate. A single power source is individually connected to each of the phase shifter elements and, in turn, each phase shifter element is connected to an antenna radiating element. As envisioned for the present invention, the finite lengths of each phase shifter element are all substantially equal to each other.

An electrical coil is disposed around selected portions of the substrate, and a driver is connected with the coil to send a current through the coil. Consequently, the flow of current through the coil induces a magnetic flux through the selected portions of the substrate. As intended for the present invention, this flux is established to influence that part of each phase shifter element which is mounted on the selected portion of the substrate. The intended result is to change the apparent length of the phase shifter elements and, thus, to shift the phase of the power passing from the power source through each phase shifter element in the subarray.

In one embodiment of the present invention, each phase shifter element is bifurcated into a first segment and a second segment. For this embodiment, although the finite length of each phase shifter element remains equal to the finite lengths of the other phase shifter elements in the subarray, the first segment of each phase shifter element is different from the first segments of the other elements. All phase shifter elements are disposed side by side on the substrate and are substantially parallel to each other. Further, the phase shifter elements are arranged so that, in one given direction across the phase shifter elements, the first segment of each phase shifter element is incrementally longer than the first segment of the next adjacent phase shifter element. If follows that in the opposite direction, the first segments are respectively decrementally shorter. With this configuration for the phase shifter elements, the coil is wound around only the first segments of the phase shifter elements. Accordingly, the influence of the flux field generated in the substrate is different for each phase shifter element and the plurality of phase shifter elements will differentially shift the power from the power source to direct the beam.

In another embodiment of the present invention, all phase shifter elements still have the same finite length but they are not bifurcated. Again, they are disposed substantially parallel to each other in a side by side relationship on the substrate. For this embodiment, however, the coil is tapered to surround different lengths of the phase shifter elements. The result, as with the other embodiment of the present invention, is that the influence of the flux field generated in the substrate is different for each phase shifter element and the plurality of phase shifter elements will differentially shift the energy from the power source to direct the beam radiating from the antenna.

For purposes of the present invention, it is intended that the driver will activate the coil to produce a sweep of the beam which will cover an arc of approximately one hundred and eighty degrees. Further, it is intended that the scan time for each sweep of the beam will be approximately equal to one hundred milliseconds. Within these parameters, and depending on the orientation of the antenna, the beam can be swept either in azimuth or in elevation.

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 1 is a top view of a boat which is using the present invention to avoid a collision;

FIG. 2 is a perspective view of an encased phase shifter subarray of the present invention;

FIG. 3 is a schematic diagram of the phase shifter subarray as would be seen along the line 3—3 in FIG. 2 and connected to an antenna;

DESCRIPTION OF THE PREFERRED EMBODIMENTS

Figure 4:
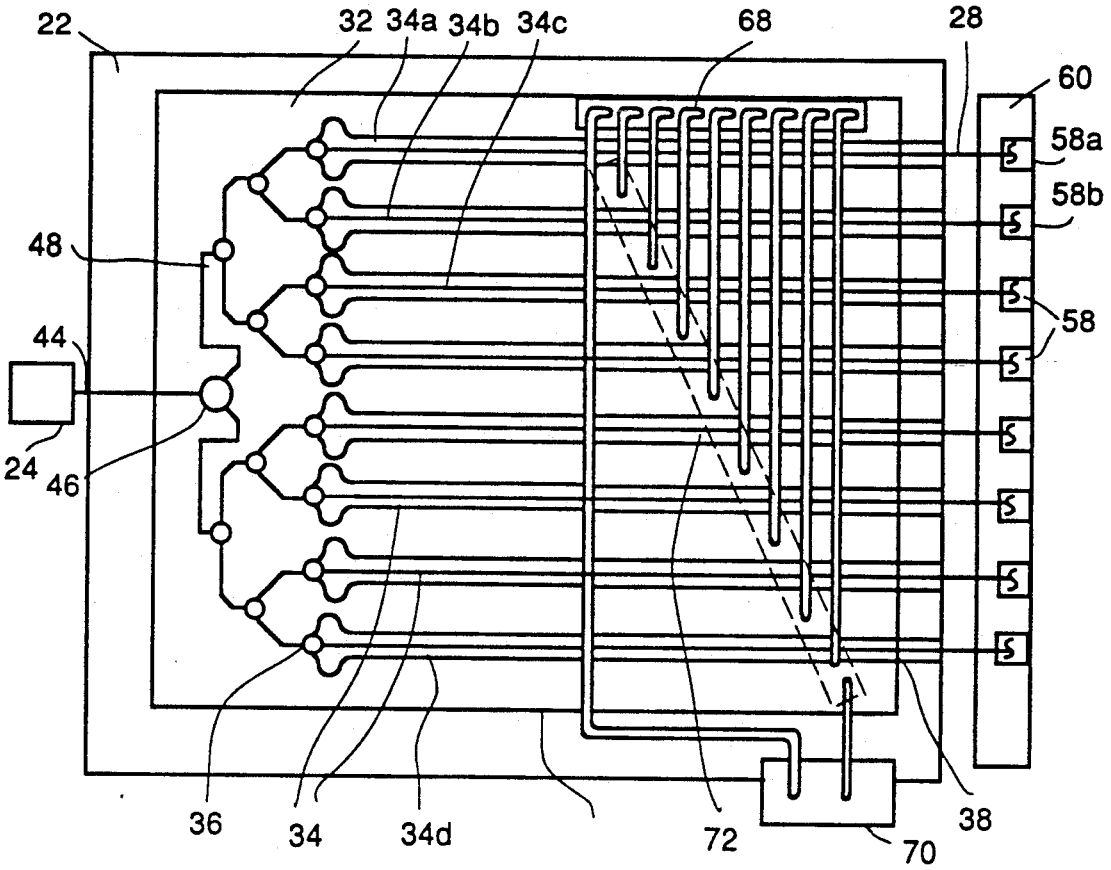
FIG. 4 is a schematic diagram of an alternate embodiment of the phase shifter subarray of the present invention as would be seen along the line 3—3 in FIG. 2 and connected to an antenna with portions shown in phantom for clarity.

Referring initially to FIG. 1 a system for a phased array radar is shown in an operational environment and is designated 10. Specifically, as shown, the radar system 10 is being employed on a boat 12 for the purposes of collision avoidance. As will be readily appreciated, boat 12 is only exemplary and any relatively slow moving vehicle, such as a car or a light aircraft, could also benefit from the use of the present invention.

In the operation of the present invention, a beam 14 is radiated by the system 10 and is aimed in a direction indicated by the angle 16. In order to detect targets, and thereby avoid a possible collision, the direction for beam 14, as measured by the angle 16 from a base line 18, is swept back and forth in the directions indicated by the arrow 20. Specifically, in one pass, the beam 14 will sweep through an arc of approximately one hundred and eighty degrees (180°). Additionally, it is intended that the scan time which is required for beam 14 to sweep through this one arc will be on the order of approximately one hundred milliseconds (100 msec). With all this in mind, attention is now focused on the electronic componentry which allows the direction of the beam 14 to be controlled. Specifically, the focus here is on cooperation of the plurality of phase shifters which are necessary to alter the power phase at each radiating element of the radar's antenna and thereby control the direction of the beam 14.

FIG. 2 shows that the phase shifter subarray of the present invention can be housed in a case 22 and that a power source 24 is connected via a line 26 to the phase shifter subarray which is housed in case 22. For the present invention, power source 24 is most likely what is commonly referred to in the pertinent art as an R.F. (radio frequency) feed. FIG. 2 also shows that a plurality of lines 28 extend from the case 22. As will be more apparent in light of subsequent disclosure, these lines 28 provide the connection between individual elements of the phase shifter subarray housed in case 22 and the antenna of the radar system 10.

One embodiment of a phase shifter subarray according to the present invention is shown in FIG. 3 and is generally designated 30. There it will be seen that the subarray 30 is housed in case 22 includes a ferri-magnetic substrate 32 and that a plurality of phase shifter elements 34 are mounted on the substrate 32. The indicated phase shifter elements **34*a*, 34*b*, 34*c* and 34*d* are only exemplary. Preferably, these phase shifter elements 34 are attached to the substrate 32 by any printing and plating technology which is well known in the pertinent art. Further, using such technology it is preferably that the phase shifters 34** be of a type known in the art as a Strahan/Lee three element micro-stripline phase shifter. A description of such a phase shifter is not presented here because most any form of phase shifter which is known in the pertinent art can be used for the purposes of the present invention. More specifically, it is intended that the present invention be operable with any waveguide or coaxial line component which will produce the necessary selected phase delay in the signal to be transmitted.

Referring specifically to the phase shifter element **34*d* in FIG. 3, it is to be appreciated that the element 34*d*, like all of the other phase shifter elements 34, has a finite length between its end points 36 and 38. For the particular embodiment of the present invention shown in FIG. 3, however, this finite length consist of a first segment 40 and a second segment 42. Further, it will be seen that although the finite lengths of all phase shifter elements 34 are substantially the same, the first segments 40 and second segments 42 of each phase shifter element 34 is different in length from the respective first and second segments in the other phase shifter elements 34. As shown, the phase shifter elements 34 are all arranged on the substrate 32** in a side by side relationship, and they are substantially parallel to each other. More particularly, in this configuration it is to be noted that the first segments 40 of the various phase shifter elements 34 incrementally increase in length going in the direction from element 34*d* to element 34*a*. Conversely, the first segments 40 are decrementally shorter in the opposite direction.

FIG. 3 also shows that a common power source 24 is used to cascade power to each of the phase shifter elements 34 on substrate 32. Specifically considering the link between power source 24 and the phase shifter element 34*a*, it will be seen that electromagnetic wave power is first transmitted through a feed 44 to a power splitter/combiner 46 At power splitter/combiner 46, the power destined for phase shifter element 34*a* then passes along a line 48 to another power splitter/combiner 50 and, thence along a line 52 to yet another power splitter/combiner 54. Finally, the power passes along line 56 to the phase shifter element 34*a*. FIG. 3 shows that this power then passes through the phase shifter element 34*a*, where the phase of the power may be altered, and through the line 28 to a radiating element 58*a* which is mounted on an antenna 60. Antenna 60 includes a plurality of radiating elements 58, one for each phase shifter element 34(e.g., 58*a* for 34*a*, 58*b* for 34*b*, etc.). As will be readily appreciated by the skilled artisan, a similar scenario can be set out for the transmission of power from the power source 24 through the subarray 30 to each of the other phase shifter elements 34 in the subarray 30.

The altering or shifting of one phase in power as it passes through the subarray 30 is accomplished by inducing a magnetic flux in the substrate 32 which will differentially affect the various phase shifter elements 34 in a predictable manner. In accordance with the present invention, this is accomplished by using an electrical coil 62 which is disposed on selected portions of the substrate 32. Specifically, the coil 62 is disposed on substrate 32 to influence only the first segments 40 of the plurality of phase shifter elements 34. Consequently, by a phenomenon well known in the pertinent art, whenever the driver 64 is activated to pass an electrical current through the coil 62, a flux field 66 will be induced in the substrate 32. Importantly, the alignment of the phase shifter elements 34 on substrate 32, and the positioning of the coil 62 on the substrate 32, are such that an operative portion of the generated flux field 66 will be in alignment with the path of the power passing through the phase shifter element 34. As is well known to the skilled artisan, the magnitude of this flux field 66 can be used to change the apparent length of the phase shifter element 34 and thereby alter or shift the phase of the power passing therethrough. Due to the fact that each phase shifter element 34 is differentially influenced by the flux field, as a result of the different lengths in their respective first segments 40, the direction of beam 14 which is radiated from the radiating elements 58 is effectively controlled.

For the alternate embodiment of the present invention shown in FIG. 4, with like elements indicated by the same reference numerals, the arrangement of phase shifter elements 34 on substrate 32, and the power feed from power source 24 to the elements 34 remain essentially unchanged. There are, however, some significant structural differences in the cooperation of the elements 34 with an influencing flux field. First, the phase shifter elements 34 are unitary and are not bifurcated. They all, however, still have substantially the same finite length. Second, the differential influence which a flux field will have on the various phase shifter elements 34 is created by a tapered coil 68 which generates a tapered flux field rather than by subjecting different lengths of the elements 34 to a tailored flux field.

As shown in FIG. 4, the tapered coil 68 is positioned on the substrate so that it is effectively coupled to increasingly longer portions of the phase shifter elements 34 as you move in the direction from element 34*d* to element 34*a*. Conversely, decreasingly shorter portions of the phase shifter elements 34 are influence by the tapered coil 68 as you move in the direction from element 34*a* to 34*d*. Consequently, as the driver 70 is activated to send current through tapered coil 68, a tapered flux field 72 is generated in the substrate 32. Since the phenomenon whereby the power phase is altered or shifted is the same for either of the embodiments disclosed herein, the overall result (i.e. directional control for beam 14) is essentially the same.

Figure 5:
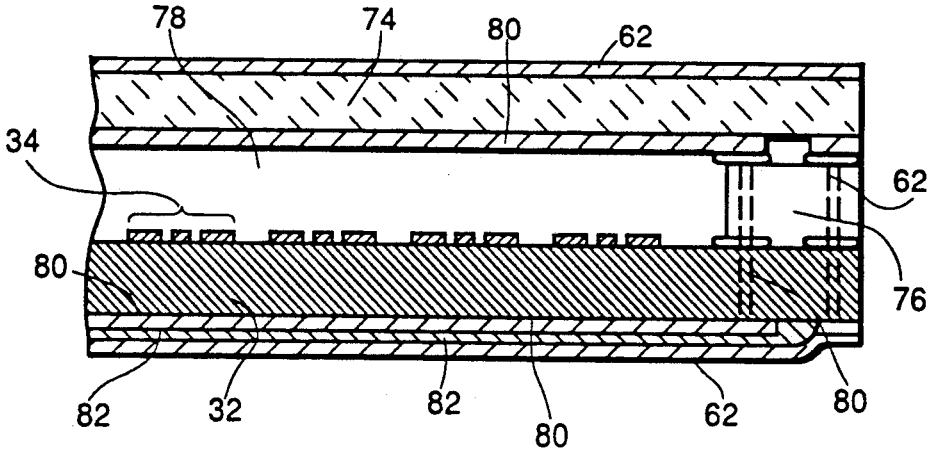
FIG. 5 is a partial cross sectional view of the phase shifter subarray as seen along the line 5—5 in FIG. 2 with portions shown in phantom for clarity.

The construction of the coil 62 and its interaction with the phase shifter elements 34 on ferri-magnetic substrate 32 will, perhaps, be best appreciated with reference to FIG. 5. It is to be noted that the discussion here relative to the coil 62 applies equally to a possible construction for the coil 68 in the alternate embodiment of the subarray 30. For coil 62, however, it will be seen in FIG. 5 that the substrate 32 is distanced from a ceramic superstrate 74 by a spacer block 76. Thus, spacer block 76 creates an air chamber 78 between the substrate 32 and the superstrate 74. As shown, the plurality of phase shifter elements 34 are deposited on the substrate 32 so as to be in the air chamber 78 and the coil 62 is then looped around both the substrate 32 and the superstrate 74 substantially as shown. A ground plane 80 is created around the substrate 32 and the air chamber 78 and, wherever necessary, this ground plane 80 is separated from the coil 62 by a dielectric 82. Consequently, the ferri-magnetic substrate and the phase shifter elements 34 are electrically isolated from the coil 62. Nevertheless, these components are positioned such that a current passing through the coil 62 will create a flux field in the substrate 32 that operatively alters the phase of power which passes through the phase shifter elements 34. It is important to recognize that the manufacture of the subarray 30 is facilitated by the fact that most components can be deposited on either the substrate 32 or the superstrate 74 by any printing or plating process that is well known in the pertinent art.

While the particular phase shifter subarray for use in directing a beam of electromagnetic waves from radiating elements of a phased array antenna as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

We claim:

1. A phase shifter subarray for use in directing a beam of electromagnetic waves generated by radiating elements of a phased array antenna, comprising:

a magnetic substrate having a longitudinal axis, a first edge and a second edge, said first and second edges being disposed parallel to the longitudinal axis and one another;

a plurality of phase shifter elements, each phase shifter element being associated with a corresponding radiating element of the phased array antenna, each element having a first end, a second end and a finite length which is substantially equal for all elements, said elements being attached to said substrate adjacent to and spaced apart from one another in a direction from the first edge to the second edge, each said phase shifter being coupled to a corresponding radiating element of the phased array antenna at said second end;

an electrical coil wound around said phase shifter elements in a direction transverse to the longitudinal axis.

means for feeding energy coupled to each said phase shifter element at the respective first ends thereof; and a driver coupled to said coil for sending current through said coil to induce a magnetic flux through said phase shifter elements, wherein said coil is wound about said phase shifter elements such that a first turn of said coil winds around a first phase shifter element at said first edge, a second turn of said coil winds around said first phase shifter element and an adjacent phase shifter element, with each successive turn winding around an increasing number of phase shifter elements until the final turn encompasses all the phase shifter elements.

2. A phase shifter subarray as recited in claim 1 wherein said means for feeding energy comprises a power supply and a common feed connected to the first end of each said phase shifter element in said subarray.

3. A phase shifter subarray as recited in claim 1 wherein said substrate comprises a ferri-magnetic substrate.

4. A phase shifter subarray as recited in claim 1 wherein said driver includes means for sweeping the beam through an arc of approximately 180°.

5. A phase shifter subarray as recited in claim 4 wherein said driver includes scanning means for providing a scan time of approximately 100 ms for sweeping the beam through said arc.

6. A phase shifter subarray for use in directing a beam of electromagnetic waves generated by radiating elements of a phased array antenna, comprising:

a magnetic substrate having a longitudinal axis, a first edge and a second edge, said first and second edges being disposed parallel to the longitudinal axis and one another, a plurality of phase shifter elements, each phase shifter element being associated with a corresponding radiating element of the phased array antenna, each element having a first end, a second end and a finite length which is substantially equal for all elements, said elements being attached to said substrate adjacent to and spaced apart from one another in a direction from the first edge to the second edge, each said phase shifter being coupled to a corresponding radiating element of the phased array antenna at said second end, means for feeding energy coupled to each said phase shifter element at the respective first ends thereof, wherein each phase shifter element comprises first and second segments, separated from one another, each said first segment being coupled to the corresponding radiating element at said first end thereof, wherein said first segment of each phase shifter element has a corresponding first length, said first length which increases incrementally from phase shifter to adjacent phase shifter element in the direction from said first edge to said second edge, while said corresponding second segments have a corresponding second length which decreases incrementally from phase shifter to adjacent phase shifter element in the direction from said first edge to said second edge;

an electrical coil wound around said first segments of said phase shifter elements in a direction transverse tot he longitudinal axis such that each turn of said coil encompasses all of said first segments and the number of turns is equal to at least he number of phase shifter elements; and a driver coupled to said coil for sending current through said coil to induce a magnetic flux through said phase shifter elements.

7. A phase shifter subarray as recited in claim 6 wherein said means for feeding energy comprises a power supply and a common feed connected to the first end of each said phase shifter element in said subarray.

8. A phase shifter subarray as recited in claim 6 wherein said driver includes means for sweeping the beam through an arc of approximately 180°.

9. A phase shifter subarray as recited in claim 6 wherein said driver includes scanning mans for providing a scan time of approximately 100 ms for sweeping the beam through said arc.

* * * * *